US005349987A

United States Patent [19]

Shieh

[11] Patent Number: 5,349,987

[45] Date of Patent: Sep. 27, 1994

[54] FAUCET WITH A MOVABLE EXTENSION NOZZLE

[76] Inventor: Ming-Dang Shieh, No. 18, Tou Lun Lane, Tou Lun Li, Lu Kang Chen, Chang Hua Hsien, Taiwan

[21] Appl. No.: 185,008

[22] Filed: Jan. 24, 1994

[51] Int. Cl.[5] ..... B05B 15/06

[52] U.S. Cl. ..... 137/801; 239/588

[58] Field of Search ..... 137/801; 239/588; 251/155

[56] References Cited

U.S. PATENT DOCUMENTS 5,009,247 4/1991 Oberdörfer ..... 137/801 X

*Primary Examiner*—Arnold Rosenthal

*Attorney, Agent, or Firm*—Bacon & Thomas

[57] ABSTRACT

A faucet includes a barrel received in the casing thereof and defining a water mixing chamber, a control switch received inside the barrel and moved by an operating lever to control hot/cold water flow rate, a socket fastened to the unitary bottom disk of the barrel to hold a hot water intake pipe, a cold water intake pipe, and a water outlet pipe, a movable nozzle detachably mounted on the casing and connected to the water outlet pipe by a bellows expansion tube, wherein a screw is threaded into a screw hole on the casing and engaged into a guide groove on the outside wall of the socket to limit the moving angle of the casing relative to the socket; a locating ring is fastened to the socket at the bottom by hooks to guide and smoothen the movement of the bellows expansion tube; a locating plate is mounted around the water outlet pipe and having two wing plates attached to the hot and cold water intake pipes to hold them in place.

1 Claim, 4 Drawing Sheets

FAUCET WITH A MOVABLE EXTENSION NOZZLE

BACKGROUND OF THE INVENTION

The present invention relates to faucets, and relates more particularly to such a faucet that has a movable extension nozzle, detachably mounted on the casing thereof.

A variety of faucets have been disclosed, and have appeared on the market. The faucet in a kitchen is generally fixed to the wall above the sink, therefore the things to be washed must be washed in the sink. When to wash the sink or other apparatus, a hose must be used and connected to the faucet so that cleaning water can be guided to the desired place.

FIGS. 1 and 2 show a faucet having a movable extension nozzle. Because the extension nozzle can be moved some distance from the faucet, this structure of faucet is very practical for use in the kitchen. The faucet comprises a casings, in an open barrel received inside the casing, a disk sealed inside the open barrel by a water seal ring, a cold water intake pipe and a hot water intake pipe and a water outlet pipe inserted into the barrel from the bottom and connected to a respective hole on the disk, a hot/cold water flow rate control switch disposed inside the open barrel above the disk, an operating lever mounted on the casing at the top and moved to control the hot/cold water flow rate control switch, a movable nozzle detachably mounted on the spout of the casing, a bellows expansion tube connected between the movable nozzle and the outlet pipe. By means of controlling the hot/cold water flow rate control switch, hot/cold water flows into the chamber defined within the open barrel above the disk and then flows through the water outlet pipe to the movable nozzle via the bellows expansion tube. The casing can be turned on the open barrel in either direction to change the direction of the movable nozzle. This structure of faucet is complicated in structure and therefore it is difficult to assemble. A water leakage tends to happen during the installation of the structure of faucet. Because the open barrel is made of cast brass, the bellows expansion tube may be damaged easily when it is pulled. The bellows expansion tube may also be twisted when the casing is turned in either direction. Frequently twisting the bellows expansion tube will cause it damaged. Still another drawback of this structure of faucet is that the casing must be installed during the test of the faucet, therefore the brilliant surface of the casing may be damaged easily during the test.

SUMMARY OF THE INVENTION

The present invention eliminates the aforesaid drawbacks. It is therefore one object of the present invention to provide a faucet which has a movable nozzle detachably mounted on the casing thereof and connected to the water outlet pipe by a bellows expansion tube. It is another Object of the present invention to provide a faucet having a movable nozzle which is simple in structure and easy to install. It is still another object of the present invention to provide a faucet having a movable nozzle connected to the water outlet thereof by a bellows expansion tube which can be turned to change the direction of the movable nozzle without damaging the bellows expansion tube. It is still another object of the present invention to provide a faucet having a movable nozzle connected to the water outlet pipe thereof by a bellows expansion tube which can be tested before the installation of the casing thereof. It is still another object of the present invention to provide a movable nozzle connected to the water outlet pipe thereof by a bellows expansion tube which has a locating ring to guide the bellows expansion tube permitting the bellows expansion tube to be pulled without causing any damage.

DETAILED DESCRIPTION OF THE PREFERRED EMBODIMENT

Figure 1:
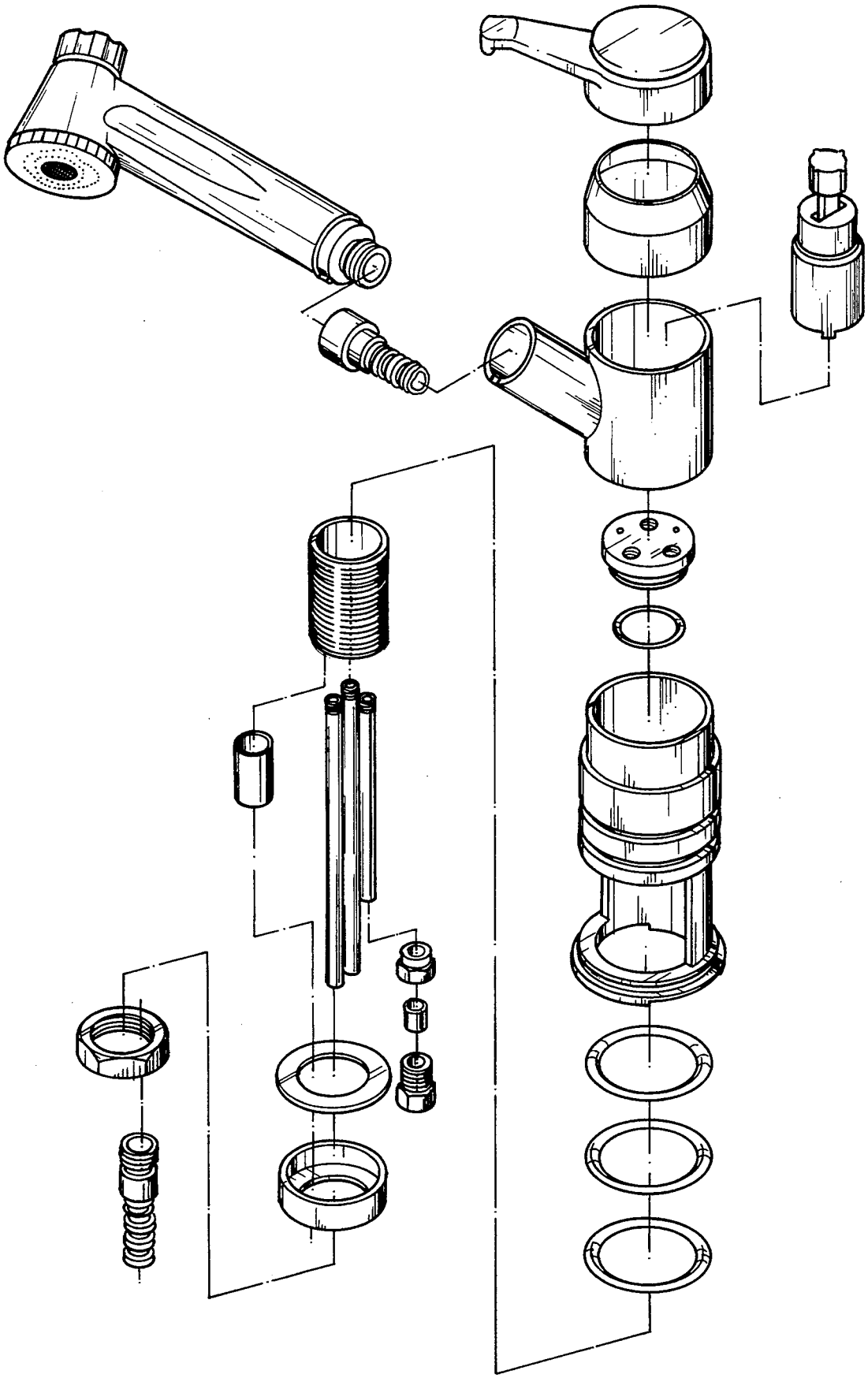
Fig. 1 PRIOR ART
FIG. 1 is an exploded view of a faucet according to the prior art.
Figure 2:
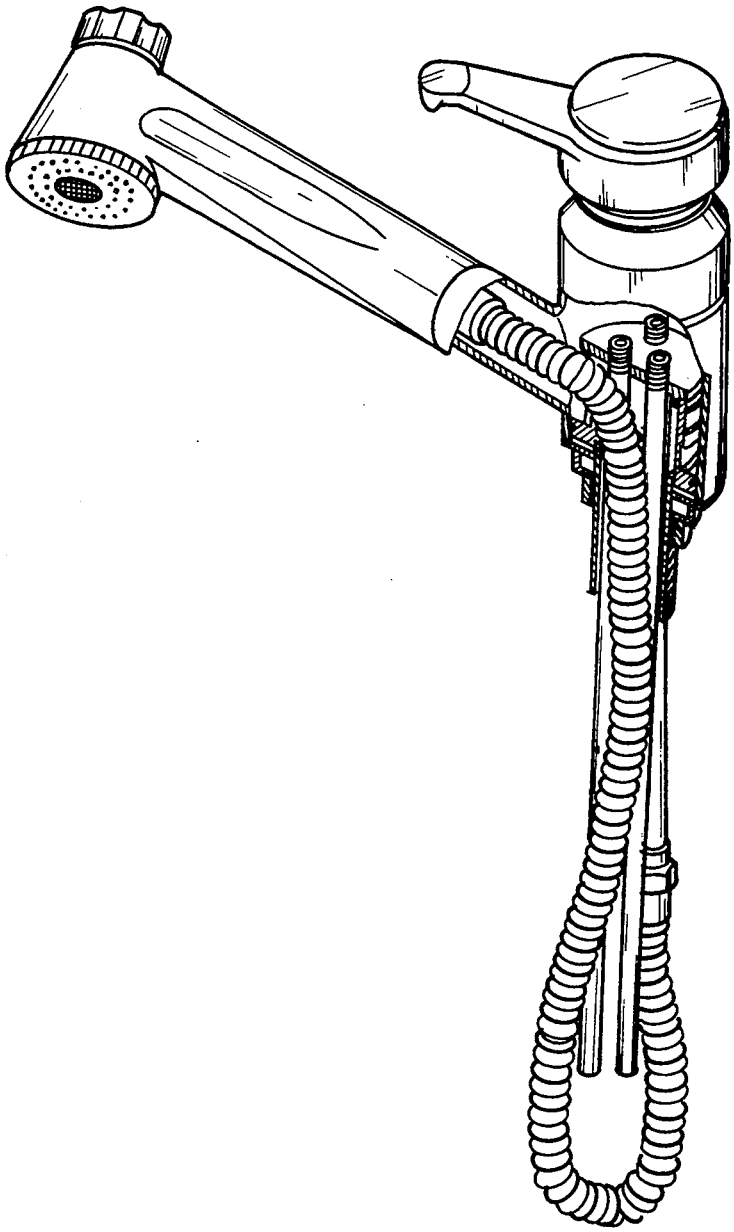
Fig. 2 PRIOR ART
FIG. 2 is a cutaway of the faucet shown in FIG. 1.
Figure 3:
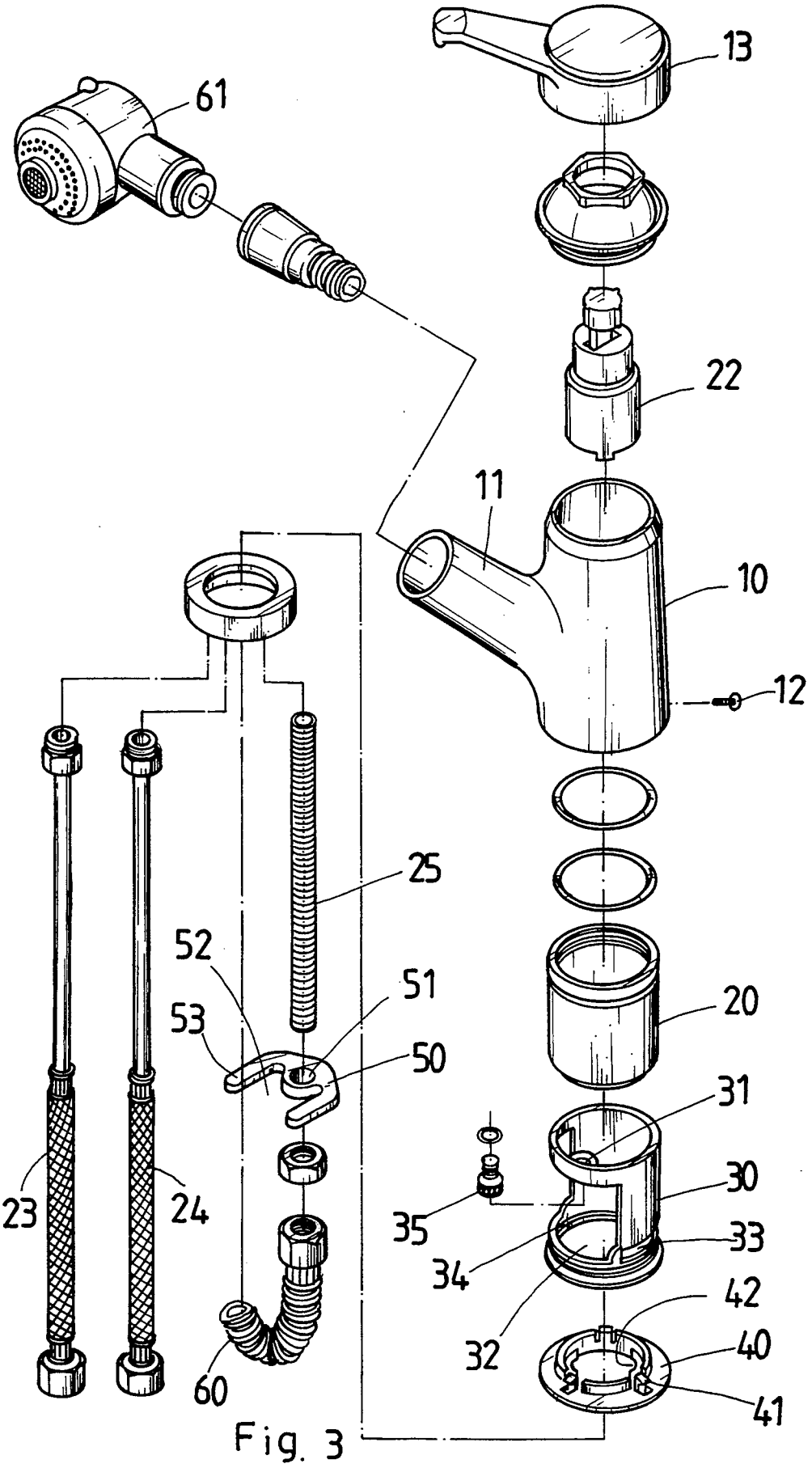
FIG. 3 is an exploded view of a faucet according to the preferred embodiment of the present invention.
Figure 4:
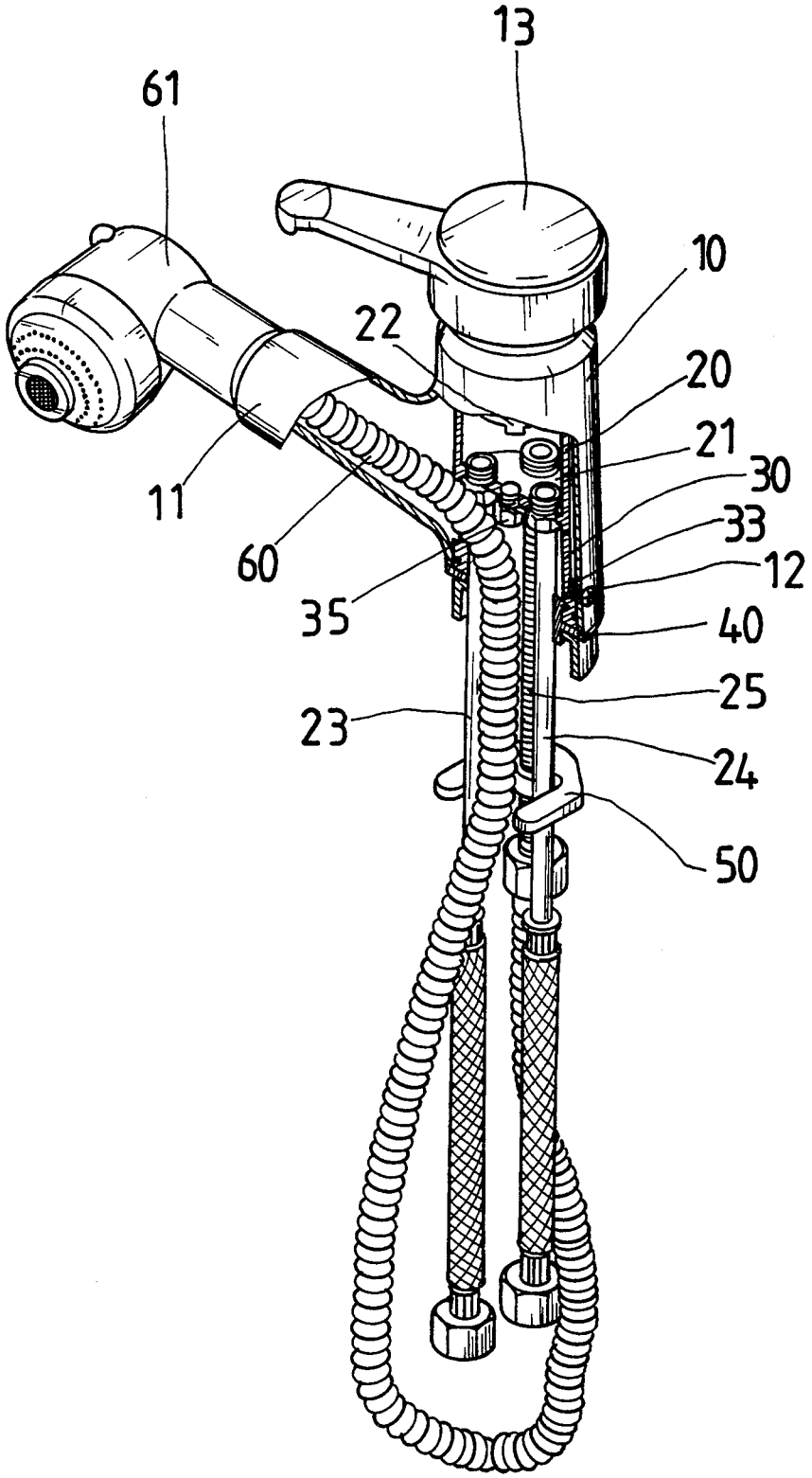
FIG. 4 is a cutaway of the faucet shown in FIG. 3.

Referring to FIGS. 3 and 4, a faucet in accordance with the present invention is generally comprised of a casing 10, a water mixing barrel 20, a socket 30, a hot/-cold water flow rate control switch 22, a locking ring 40, a locating plate 50, a hot water intake pipe 23, a cold water intake pipe 24, a water outlet pipe 25, a bellows expansion tube 60, a nozzle 61, and an operating lever 13. The casing 10 has a spout 11 through which the bellows expansion tube 60 passes. The water mixing barrel 20 is received inside the casing 10, ;having a unitary bottom disk 21 blocked at the bottom. The bottom disk 21 has screw holes (not show) to which the hot water intake pipette 23, the cold water intake pipe 24, and the water outlet pipe 25 are respectively fastened. The hot/cold water flow rate control switch 22 is received inside the water mixing barrel 20. The socket 30 is received inside the casing 10 and connected to the water mixing barrel 20 at the bottom. The socket 30 comprises an inside projecting block 31 fastened to the bottom disk 21 of the water mixing barrel 20 by a screw 35, a side opening 32 at one side, through which the bellows expansion tube 60 passes, an outside guide groove 33 horizontally disposed at an opposite side, into which a screw 12 which is threaded into a screw hole (not shown) on the casing 10 engages (the length of the outside guide groove 33 limits the moving range of the casing 10 relative to the socket 30), and an inside annular groove 34 made around the inside wall thereof at the bottom, to which the locating ring 40 is fastened. The locating ring 40 comprises a plurality of hooks 41 spaced around a circle and respectively hooked into the inside annular groove 34 of the socket 30, and two half-round grooves . 42 on the inside wall thereof at two opposite sides for positioning the hot and cold water intake pipes 23;24. The inside surface of the locating ring 40 is made smooth so that the bellows expansion tube 60 can moved in and out smoothly. After the hot and cold water in take pipes 23;24 and the water outlet pipe 25 have been respectively fastened to the bottom disk 21 of the water mixing barrel 20, the locating plate 50 is mounted around the water outlet pipe 25 to retain the hot and cold water intake pipes 23;24 in place. The locating plate 50 comprises a through hole 51, which receives the water outlet pipe 25, two wing plates 53 defining a mouth 52, which receives the hot and cold water intake pipes 23;24. The bellows expansion tube 60, has one end connected to the output end of the water outlet pipe 25 (the input end of the water outlet pipe 25 is connected to the bottom disk 21 of the water mixing barrel 20), and an opposite end inserted through the locating ring 40 from the bottom into the socket 30 and extended out of the side opening 32 of the socket 30 and the spout 11 of the casing 10 and then connected to the nozzle 61. The lever 13 is mounted on the casing 10 at the top and moved to control the hot/cold water flow rate control switch 22.

Because the bottom disk 21 is integrally molded on the barrel 20 at the bottom and the water mixing chamber defined within the barrel 20 is simultaneously provided for holding the hot/cold water flow rate control switch 22, the structure of the faucet is simplified for quick assembly without causing any leakage of water. The faucet can be tested after its installation before the mounting of the casing 10, and therefore the casing 10 will not be damaged during the test. The arrangement of the screw 12 and the guide groove 33 confines the moving range of the casing 10 in either direction, therefore turning the casing 10 in either direction relative to the barrel 20 does net twist the bellows expansion tube 60. Further lore, the smooth inside surface of the locating ring 40 permitting the bellows expansion tube 60 to be smoothly moved in and out without causing any damage.

I claim:

1. A faucet comprising a casing having a spout, a barrel received inside said casing, a socket received inside said casing and connected to said barrel at the bottom, a hot/cold water flow rate control switch received inside said casing, a water outlet pipe and a hot water intake pipe and a cold water intake pipe respectively connected to said barrel and retained in place by a locating ring and a locating plate, a nozzle detachably mounted on the spout of said casing, a bellows expansion tube connected between said barrel and said nozzle, and an operating lever mounted on said casing at the top and moved to control said hot/cold water flow rate control switch, wherein said barrel defines a water mixing chamber, which receives said hot/cold water flow rate control switch, and comprises a unitary bottom disk blocked at the bottom, said bottom disk having holes to which said hot and cold water intake pipes and said water outlet pipe are respectively connected; said socket has an elongated guide groove horizontally disposed on an outer surface thereof, and an inside annular groove made around an inside wall thereof at the bottom; said casing comprises a screw threaded into a screw hole thereof on the outside and having a tip engaged into the elongated guide groove said socket to limit the turning angle of said casing in either direction relative to said socket; said locating ring comprises a plurality of hooks respectively hooked in the inside annular groove on said socket, a smooth inside surface surrounding said hot and cold water intake, pipes and said water outlet pipe; said locating plate comprises a through hole through which said water outlet pipe passes, and two wing plates mounted around said hot and cold water intakes pipes to hold them in place.

* * * * *